United States Patent [19]

Chorlton et al.

[11] Patent Number: 4,662,865

[45] Date of Patent: May 5, 1987

[54] SHEET MATERIAL SAMPLES AND MANUFACTURE THEREOF

[75] Inventors: Samuel N. Chorlton, Hyde; David R. Murray, Wash, both of United Kingdom

[73] Assignee: Weston Hyde Products Limited, Hyde, England

[21] Appl. No.: 804,913

[22] Filed: Dec. 5, 1985

[30] Foreign Application Priority Data

Aug. 13, 1985 [GB] United Kingdom ..... 8520271

[51] Int. Cl.[4] ..... B31C 13/00

[52] U.S. Cl. ..... 493/356; 493/363; 493/395; 493/462; 283/105; 281/2; 281/5; 206/44.11; 206/494; 229/DIG. 4; 242/56.8

[58] Field of Search ..... 493/287, 303, 352, 356, 493/462, 405, 395, 363; 283/105; 281/2, 5; 206/44.11, 494; 53/117, 118; 428/58, 128; 229/DIG. 4, 69; 242/56.8

[56] References Cited

U.S. PATENT DOCUMENTS

| | | | |
|---|---|---|---|
| 1,378,063 | 5/1921 | Swick | 281/2 |
| 2,018,855 | 10/1935 | Imshaug | 494/363 |
| 2,589,641 | 3/1952 | Stewart | 206/44.11 |
| 2,627,427 | 2/1953 | Weimont | 281/5 |
| 3,382,779 | 5/1968 | Lynas | 493/287 |
| 3,518,810 | 7/1970 | Steeves | 493/287 |
| 3,986,756 | 10/1976 | Kranich | 206/44.11 |
| 4,165,678 | 8/1979 | Hart | 493/303 |
| 4,171,047 | 10/1969 | Doyle et al. | 206/494 |

FOREIGN PATENT DOCUMENTS

| | | | |
|---|---|---|---|
| 201296 | 1/1956 | Australia | 206/44.11 |
| 1285257 | 8/1972 | United Kingdom | 281/5 R |

*Primary Examiner*—Frederick R. Schmidt
*Assistant Examiner*—William E. Terrell
*Attorney, Agent, or Firm*—Salter & Michaelson

[57] ABSTRACT

A sample pack comprises a piece of sheet material (1) folded to reduce its width by half along its longitudinal axis and then folded again about one or more axes transverse to the longitudinal axis before being rolled about a transverse axis. The longitudinal fold line (2) is slitted at intervals to release pressure in the material to promote folding and rolling. The material is advantageously wallpaper and the sample provides a viable alternative to cumbersome pattern books.

9 Claims, 7 Drawing Figures

FIG. 5
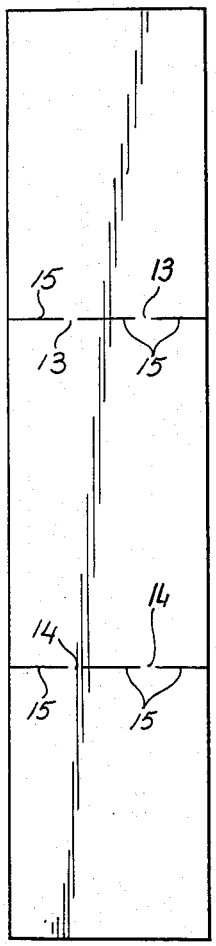
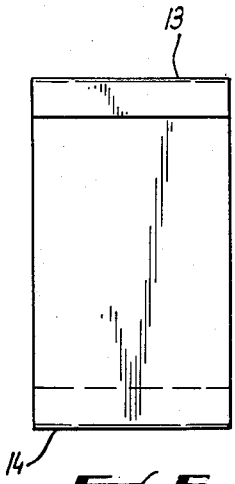
FIG. 6
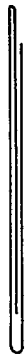
FIG. 7

SHEET MATERIAL SAMPLES AND MANUFACTURE THEREOF

The present invention relates to samples and particularly, but not exclusively, to samples in the form of packs of wallpaper.

At the present time it is the common practice to provide sample books comprising a large number of wallpaper samples of differing designs. These books are bulky, and therefore, space consuming. They are expensive to produce and therefor of limited availability. They are unwieldy to use, for example, difficult to hold up against a wall in an open condition in order to determine the visual effect of the chosen wallpaper on the wall. Also they are too bulky satisfactorily to transport from place to place for comparison purposes. Furthermore, once removed from the store or shop by one customer they are unavailable for use by other customers. Conversely, they should only be in the possession of any one customer for a limited period as a result of which they are unavailable for reference for a longer period. By their size and variety of designs contained in them such book can actually make choice more difficult. Pattern books also limit the manufacturers flexibility since the should maintain stocks of every sample in the pattern book for the duration of the pattern book, possibly two years or more.

According to one aspect of the present invention there is provided a sample pack comprising a piece of sheet material which is folded to reduce its effective width having a series of slits along the fold line and coiled about an axis transverse to the fold line.

According to another aspect of the present invention there is provided a piece of sheet material having a fold line extending from one edge thereof to another enabling the sheet to be folded to reduce its width and a series of slits extending along the fold line.

According to a further aspect of the present invention there is provided a method of producing a sample pack from a sheet of material including the steps of producing a series of slits from one edge of the sheet to the other, folding the sheet along the series of slits to reduce the effective width of the sheet and rolling the folded sheet about an axis transverse its width.

In order the the invention may be more clearly understood, one embodiment thereof will now be described, by way of example, with reference to the accompanying in which:

FIGS. 5 to 7 show a modification of the pack of FIGS. 1 and 2.

Figure 2:
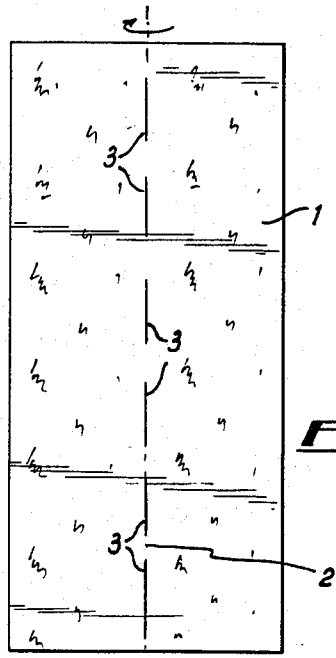
FIG. 2 shows the sheet forming the pack of FIG. 1 unwound and laid flat.
Figure 1:
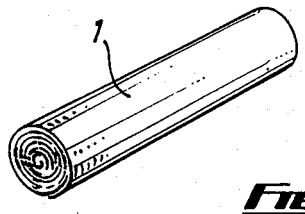
FIG. 1 shows a perspective view of a sample pack in accordance with the invention.

Referring to FIGS. 1 and 2, a sheet of wallpaper 1 approximately twenty five inches (61 cm) long by ten and a half inches wide (27 cm) is folded in half along its major dimension with the pattern to the outside. The folded width is, therefore, some five and a quarter inches (13.5 cm).

Along the fold line 2 a series of slits 3 are formed. The purpose of these slits is to release pressure in the fold when the folded sheet is subsequently coiled. The number and length of the slits would be chosen as desired depending usually upon the stiffness and thickness of the sheet of wallpaper, but it is felt that the ratio of slit to unslit length along the fold line would generally be in the region of three to four to one. For example, each slit may be 3.8 inches (9.65 cms) and each unslit portion 1 inch (2.54 cms). The slits may be formed before or after the sheet is folded although it is considered that they would be more conveniently formed before folding. The individual sheets would be severed from a large reel of wallpaper usually substantially simultaneously with the production of the slits.

The folded sheet is coiled about an axis at right angles to the major dimension of the sheet and the coil is then wrapped as conventional full size rolls of wallpaper. The finished sample pack is shown in FIG. 1. To the customer this resembles a scaled down version of a full size roll although in fact the sheet is folded.

Figure 3:
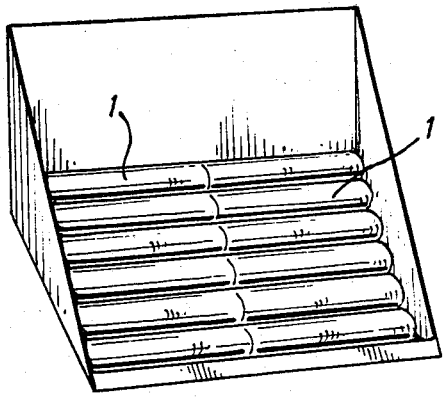
FIG. 3 shows a display unit for the sample packs of FIG. 1.
Figure 4:
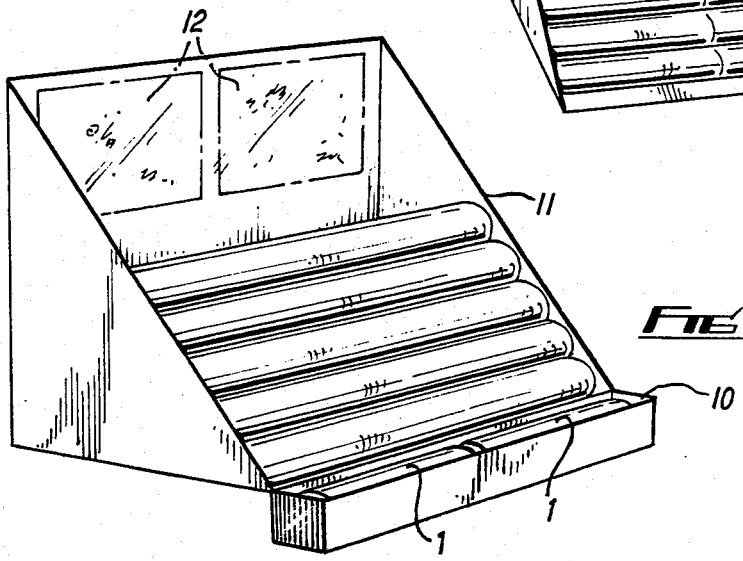
FIG. 4 shows an alternative to the unit of FIG. 3.

Several sample packs for each design of wallpaper on sale would be displayed at the retail point of sale. These may be contained in a separate display unit specially provided for that purpose, or in smaller individual units 10 provided for respective wallpaper designs and connected to the point of existing units 11 provided for displaying full size rolls. The former arrangement is illustrated in FIG. 3 and the latter in FIG. 4. Where individual units 10 are provided the existing units 11 would usually incorporate a display 12 illustrating the use of that particular wallpaper design in one or more domestic locations.

In an alternative embodiment, as a further stress reducing aid, the sheet may be folded transversely to the fold line 2 prior to coiling. This alternative is shown in FIGS. 5 to 7. In FIG. 5, the transverse fold lines are shown at 13 and 14 and the slits at 15. FIG. 6 shows the sheet folded about fold lines 13 and 14 and FIG. 7 is a side elevational view of the sheet in this folded condition. After folding, the sheet is coiled about a transverse axis as previously, the end result being substantially the same as in the previous embodiment.

In use a customer may examine the range of wallpaper designs available, select one or more sample packs of chosen design, compare them in the home to see how the colour and pattern fit in with existing or projected decor and fittings and furniture and then return to the store to purchase corresponding full size rolls of the chosen design. The size of the sheet making up the sample pack is chosen to give a good indication of what a wall decorated with the paper would look like yet at the same time be easy to handle. The length of the sheet, for example, is enough to hold up against a wall and the width is enough to give adequate pattern repeat for the majority of designs.

It is intended that a small amount be charged for each sample pack which would be deducted from the charge for a subsequent purchase of corresponding full size rolls. The above described arrangement would enable unwieldy and expensive pattern books to be dispensed with and reduce the incidence of pieces of paper being torn from full size rolls for the purpose of colour and pattern matching. The sample pack is compact enough to transport from place to place and may be retained by the customer for future reference.

It will be appreciated that the above embodiments have been described by way of example only and that variations are possible without departing from the scope of the invention.

We claim:

1. A roll of flexible material used as a sample for demonstrating and illustrating a design as incorporated in said material and defining a sample pack of a larger roll of said material, comprising a sheet of said material having a fold line formed therein, about which said sheet is folded to reduce the effective width thereof, a plurality of slits being located in said fold line in spaced apart relation, said slits as formed in said sheet extending in a direction that is substantially coincident with said fold line, said sheet being rolled up about an axis that is transverse to said fold line, and said slits acting to release pressure in said sheet along the fold line thereof as said folded sheet is rolled up into said sample pack.

2. A roll of flexible material as claimed in claim 1, said fold line dividing said sheet of material in half.

3. A roll of flexible material as claimed in claim 1, the ratio of the total length of the slits as formed in said fold line to the total unslitted portion thereof being greater than two to one.

4. A roll of flexible material as claimed in claim 1, the ratio of the total length of the slits as formed in said fold line being greater than one to one.

5. A roll of flexible material as claimed in claim 1, the ratio of the total length of the slits as formed in said fold line being greater than three to one.

6. A roll of flexible material as claimed in claim 1, said sheet material being wallpaper.

7. A roll of flexible material as claimed in claim 1, said sheet of material being folded at least once transversely with respect to said fold line as formed with the slits therein.

8. A method of forming a sample pack from a sheet of material for demonstrating and illustrating a design as incorporated in said material, comprising the steps of forming at least one fold line in said sheet for folding said sheet thereabout to reduce the effective width thereof, forming a plurality of pressure relieving slits in said fold line in spaced apart relation and in a direction that is substantially coincident therewith, folding said sheet about said fold line and thereafter rolling up said folded sheet about an axis that is transverse to said fold line into said sample pack.

9. A method of forming a sample pack as claimed in claim 8, comprising the further step of folding said sheet of material at least twice in a direction that is transverse to said fold line as slitted.

* * * * *